United States Patent [19]

Marthaler et al.

[11] Patent Number: 4,667,360

[45] Date of Patent: May 26, 1987

[54] TOOTHBRUSH

[75] Inventors: Thomas Marthaler, Zurich; Uli Witzig-Jaggi, Wolfhausen, both of Switzerland

[73] Assignee: Lever Brothers Company, New York, N.Y.

[21] Appl. No.: 792,706

[22] Filed: Oct. 29, 1985

[30] Foreign Application Priority Data

Apr. 30, 1985 [CH] Switzerland ..... 114456

[51] Int. Cl.[4] ..... A46B 9/04

[52] U.S. Cl. ..... 15/167 R; D4/104

[58] Field of Search ..... 15/167 R, 167 A, 106, 15/110, 172, 176; D4/104, 132, 105

[56] References Cited

U.S. PATENT DOCUMENTS

| | | | |
|---|---|---|---|
| 1,378,530 | 5/1921 | Evslin | 15/167 R X |
| 1,929,530 | 10/1933 | Abelson | 15/167 R |
| 2,232,269 | 2/1941 | Reuben | 15/106 |
| 4,330,896 | 5/1982 | Booth . | |

FOREIGN PATENT DOCUMENTS

| | | | |
|---|---|---|---|
| 119073 | 4/1901 | Fed. Rep. of Germany | 15/167 R |
| 592757 | 2/1934 | Fed. Rep. of Germany | 15/167 A |
| 835142 | 9/1938 | France | 15/167 R |
| 1467935 | 12/1966 | France . | |
| 85401 | 2/1936 | Sweden | 15/167 R |
| 615329 | 1/1980 | Switzerland . | |
| 1396634 | 6/1975 | United Kingdom . | |

OTHER PUBLICATIONS

"Prophylaxe: ein Leitfaden fur die zahnarztliche Praxis", Peters, 1978, pp. 71–77.

Schweiz. Machr. Zahnheilk. 82,452/40, 1972, (Allet et al.).

*Primary Examiner*—Peter Feldman

*Attorney, Agent, or Firm*—Milton L. Honig; James J. Farrell

[57] ABSTRACT

The essential feature of the new toothbrush is the relative position of the handle (1) to the head (3) and the bristle pattern (4). An angle reference plane (11) lying on the bristle side coincident with an upper surface of the brush handle intersects the bristle pattern either at the surface (15), the edge between the said surface and the side (16) facing the handle, or on the side (16) of the bristle array facing the handle. Relative to the bristle array surface (15), an acute angle ($\alpha$) of from 5° to 20° is formed between the two planes.

The new toothbrush therefore is a bristle array surface set at an angle to the handle and improved force transfer to the working surface of the bristle array.

9 Claims, 5 Drawing Figures

TOOTHBRUSH

The invention described herein relates to a toothbrush with a novel arrangement of its parts.

Today, toothbrushes have become the subject of various national standards and specifications Examples include: Jordan Specification of Toothbrushes (N4 78/63756); Australian Standard AS 1032 Toothbrushes (N5 7/63757); Canadian Standard 22-GP-6a Toothbrushes (78/63758); Federal Specification H-T-560A Toothbrushes for Adults and Children (78/63759); Israel Standard SI 863 Toothbrushes (78/63761) and Draft British Standard Specification for Toothbrushes (78/63488).

Special mention is made of Draft DIN 13917, Part 1, "Toothbrushes: terminology, dimensions, requirements". The terminology used in the above Draft DIN 13917/1 will be used herein unambiguously to describe the toothbrush of the invention and to distinguish it from known models; the reference numerals appearing in the description of the toothbrush of the invention refer to the accompanying FIGS. 1 to 4.

The toothbrush as a whole is comprised of handle 1, neck 2, and head 3. The head carries an array of bristles 4. The bristle array consists of all the bristles, arranged in single tufts.

Toothbrushes are known wherein on the bristle side the head is set at an angle to the handle. A toothbrush with only a slightly and simply angled head is shown, for example, in FIG. 1 of Swiss Patent Specification No. 615,329. Neither the claims nor the specification of the stated patent refer to the angularity. A toothbrush which similarly is only simply angled is described in Schweiz. Machr. Zahnheilk. 82, 452/40, 1972.

Toothbrushes with angled heads generally have the disadvantage that the line of action of the brush when in use, which approximately coincides with the centre line of the handle, neither lies in the plane of the bristle array nor does it with the bristle array. The transmission of muscular power to the surface to be cleaned during tooth brushing is therefore reduced. In addition, such toothbrushes have the disadvantage that they tend to tilt or slip, particularly during vigorous brushing. Guiding the brush to the surface to be cleaned becomes more difficult as the distance becomes greater between the bristle surface and the handle centre line.

Toothbrushes which have an angled neck in addition to an angled head are also known. The above-mentioned Draft DIN 13917/1 illustrates and describes such a toothbrush. In a corresponding professional publication "Prophylaxe: ein Leitfaden fur die zahnarztliche Praxis", Peters, 1978, it is stated of such toothbrushes on page 73, column 2:

> "Slightly angled or contra-angled shapes, in which the bristles lie approximately in line with the handle plane have been found to be especially suitable."

In the same publication, these toothbrushes are illustrated in several photographs on page 74.

The invention described herein provides a toothbrush design wherein effectiveness is improved by the combined effect of the angle at which the bristle array is set to the handle and the position of the bristle array relative to the handle. This combination is neither disclosed nor referred to in any of the above-cited publications.

The toothbrush of the invention will now be described with reference to the accompanying drawings. In the drawings, the solid parts of the brush body are shown in section and the angle reference plane 11' should be particularly noted. the bristle array 4 lies in a definite position relativ to this plane which plane is coincident with the plane defining the upper surface of handle 1. A special form of the bristle array 4 is inclined at an angle to the angle reference plane 11'. A second angle reference plane 110 is shown coincident with a lower surface of handle 1. The bristle head is straight and angled upwardly and the top surface of the bristle array is planar as shown in the drawing. The bristle array 4 is shown only schematically.

FIG. 1 shows a diagrammatic illustration of the toothbrush design in accordance with the invention. 1 is the brush handle, 3 the brush head and 4 the bristle array. An angle between the angle reference plane 11' and surface 15 of the bristle array is referred to as $\alpha$. The edge of the bristle array facing the handle is shown at 13 and the side of the bristle array facing the handle is shown at 16.

FIG. 2 there is shown a straight connecting member or neck 2' between the brush handle 1 and the brush head 3.

FIG. 3 shows one form of the neck, an angled connecting piece 2'' between handle 1 and head 3;

Figures 1, 2, 3, 4, 5:
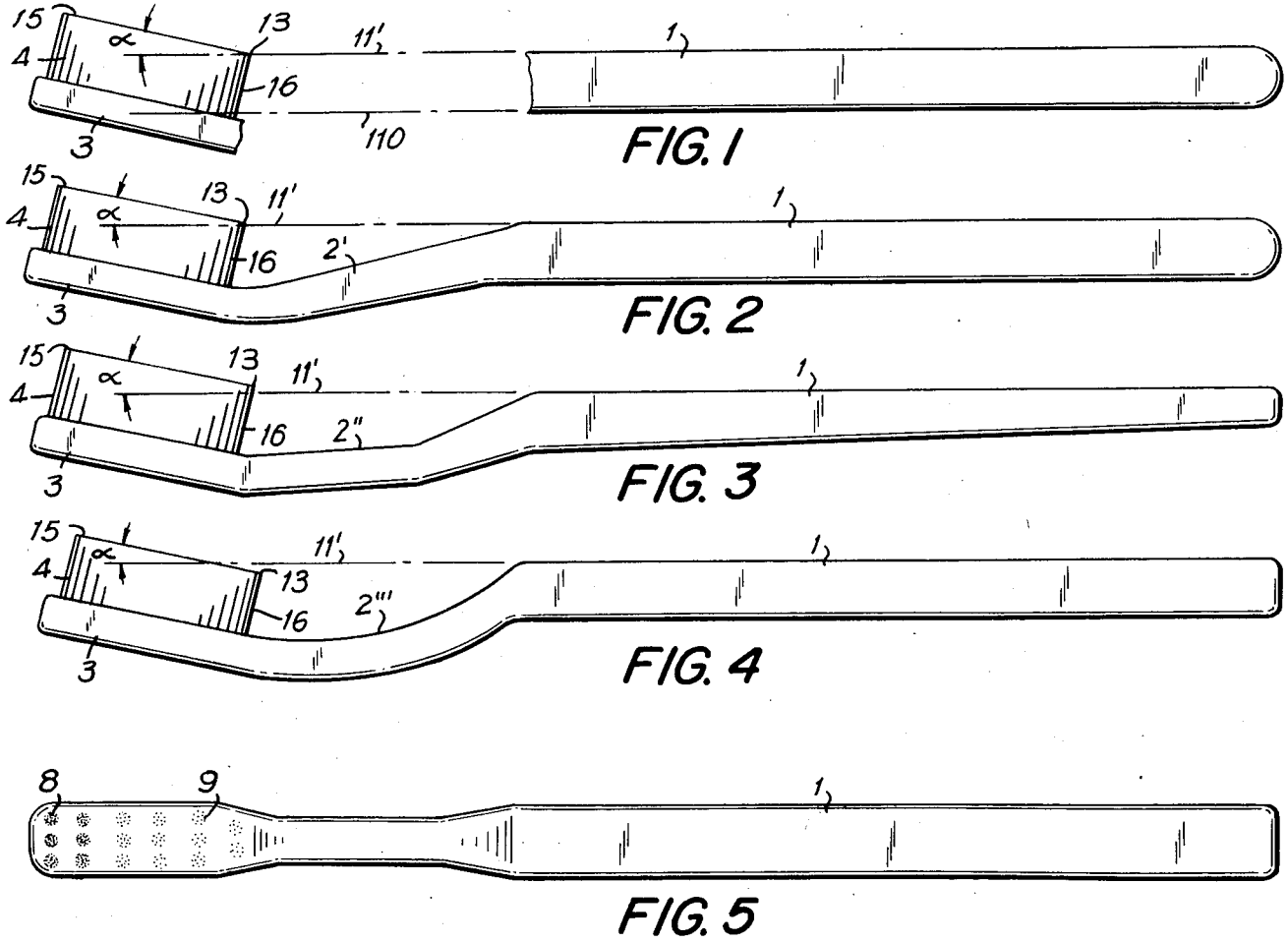
FIG. 4 shows another form of the neck—a curved connecting piece 2'''.
FIG. 5 shows the bristle tufts in a portion 8 of the bristle array remote from the handle as being denser than those tufts in the bristle array portion 9 nearest the handle.

The toothbrush of the invention can be made from the usual materials for handle, neck, head and bristles. Also different bristle arrays already known per se can be used.

In a special embodiment of the brush, the section remote from the handle, specifically the outermost part of the bristle array, has a denser arrangement of bristle tufts and the section nearest the handle has a less dense arrangement of bristle tufts. Rectangular, rounded or trapesoid shapes can be used for the brush head.

EXAMPLE

The toothbrush (C) of this invention and typical commercial toothbrushes known as the "Profilac" (A) and Elmex (B) were tested on 27 subjects and the results compared. The test subjects—young adults—were given the toothbrushes for a week in order to get accustomed to them; a 3-day-phase of plaque-growth followed. At the end of that period the test cleaning took place. Immediately afterwards a plaque index was taken, similar to that of Silness and Loe but using staining of plaque. Toothbrushes A, B and C were allocated to the test persons in all six possible sequences (A-B-C, A-C-B, etc.).

Summary of Results

Table 1, line 1, shows the mean plaque index after use of the 3 brushes. Following the use of brush C the plaque index was 1.94; this was lower and indicates that less plaque remained as compared with that after the use of the control brushes A: (2.18), B: (2.11). The difference between the three averages were statistically significant (P 0.05).

Table 1, lines 2–4, shows that the difference was seen above all on the anterior teeth and the premolars. In the molar region the mean indices were much higher than those of the anterior region; this was mainly due to the plaque on the 2nd molar. For this reason 2 further evaluations under exclusion of the 2nd molar were made.

Table 1, lines 5–6, shows that the difference between brush C and the two control brushes after exclusion of the 2nd molar was more pronounced. The separate evaluation on teeth 4 to 6 (premolars and first molars) resulted now in a marked superiority of brush C in this posterior region.

Table 4, lines 1–2, shows the mean index buccally and lingually. Toothbrush C showed better results than brushes A and B. The marked statistical significance (P 0.01) seen on the lingual surfaces indicates that brush C specifically improved plaque removal on the lingual surfaces.

The evaluation of measurements of the surface covered with plaque led to results similar to those with the plaque index. The difference between the brushes, however, were not statistically significant.

The greatest amounts of plaque weights were found on the 2nd molar. Variations of the plaque weights, however, were so pronounced that also in this case no statistical significance was found.

Plaque-Index Statistical Comparisons

The plaque index was established facially (buccal and labial surfaces) and orally (lingual and palatal surfaces) on 28 teeth (third molars were excluded) and a few premolars were missing in the test subjects.

Line 1 of Table 1 shows that the average plaque index was lower after the use of toothbrush C (1.944) than after the use of Profimed (2.181) and Elmex (2.110). In the F-test the differences between the 3 toothbrushes were statistically significant because the difference could be attributed to chance with a probability of less than 0.05 (in this case 0.0201, see Table 1).

Detailed statistical information is given in the analysis of variance shown in full in Table 2. There were significant differences between the brushes and the test subjects. The significant mean square between test subjects did not indicate that there were large variations between the 27 test subjects. The mean square was calculated to be 0.2562 and the area error variance was 0.0952. Accordingly, the variance component between test subjects was 0.0060. The variance component between brushes was equal to $(0.4015-0.0952)/3=0.1021$. This was more than ten times the variance component between the test subjects.

Lines 2 to 4 of Table 1 show averages and statistical significances regarding anterior teeth, premolar and first and second molars. Averages in the anterior teeth (line 2, teeth 1–3) were lowest, with 1.728 for brush A, 1.681 for B and 1.446 for C. The differences between the brushes were significant ($P=0.0225$).

In the premolar region (line 3, teeth 4–5) the indexes were at 2.149 (A), 2.052 (B) and 1.892 (C). In the analysis of variance the differences between the brushes was significant ($P=0.0471$). In this case the variation between the test persons was not significant.

In the molar region (line 4, teeth 6–7), the indices were substantially higher, i.e. in the order of magnitude of 2.8. Again, toothbrush C showed the best results. No statistical significance was present between the brushes ($P=0.154$); however, a difference was found between test subjects.

The high average in the molar region appears to be due primarily to the second molar which is difficult to keep clean even for test subjects experienced in oral hygiene. Therefore, additional evaluations for teeth 1 to 6 and 4 to 6 were made. The results are indicated in lines 5 and 6 of Table 1. In these two additional evaluations as well, the plaque indices were lowest after the use of brush C, and the differences between the 3 brushes were statistically significant.

The differences between test persons were significant except in line 2. They are without consequence for the comparison of the brushes. In the statistical evaluation by two-way analyses of variance the variation between test subjects is eliminated. This was possible because all 3 brushes were tested on every test subject.

In view of the new type of design of brush C it was adequate to compare the two control brushes with each other on the one hand and to compare these two brushes with brush C. This method was in accordance with the statistically preferable orthogonal subdivision of the sum of the squares into the two independent comparisons corresponding to the two following questions:

A versus B: are there differences between the two control test brushes?

C versus A and B: is the new brush better than the 2 control brushes?

Table 3 shows the results of these individual comparisons which are based on the test plan. As shown in Table 1, brushes A and B differed only slightly from one another whereas the lowest plaque indices were consistently found after the use of brush C. The smaller part of the total sum of squares (0.8031) was due to the comparison "between the two control brushes" (line 1, 0.0698) whereas the larger part (0.7333) was due to the comparison "new versus control brushes".

In none of the evaluations shown in Table 3 were the differences between the control brushes significant, all P values being above 0.2. On the contrary, statistially significant differences were found between brush C and the two control brushes except for the molar region. In 3 comparisons (teeth 1–6, i.e. all teeth except second molars), chance probability was less than 0.01.

Brush C was designed with special emphasis on better cleaning of the lingual surface. Line 1 in Table 4 shows that the averages of the buccal as well as the lingual surfaces were lowest after cleaning with brush C. The fact that statistical significance (P 0.01) was obtained lingually, but not bucally, indicates that the main advantage of brush C is indeed obtained on the lingual surfaces. The statistical significance in the overall evaluation (Table 4, line 2) is therefore mainly due to the superior cleaning effect of the test toothbrush on the lingual surfaces.

From the statistical viewpoint, counting of the number of sites showing indices of (for example) 2, 3 and 4, or else 3 and 4 is preferable; subsequent statistical tests were then based on the results of these counts. Line 3 and 4 of Table 4 show that this type of evaluation also documents the better cleaning effect of brush C. Using the orthogonal subdivision of the sum of squares, statistical significance was obtained in counting sites with a grade 3 or 4 each. Again, significance is reached on counts of the lingual surfaces.

Table 5 shows the plaque indices after cleaning with the different subtypes of brush C. There were only small differences between the 4 averages which are based on only 6 or 7 subjects each. Accordingly, the differences between these 4 averages are not significant and a differentiation between the 4 subtypes is therefore unnecessary.

TABLE 1

Average plaque-index after brushing with toothbrushes A,B,C, statistical significance (P) between brushes and between subjects (F-tests in two-way analyses of variance)

| Line, teeth | A | B | C | Significance between Brushes | Significance between Subjects |
|---|---|---|---|---|---|
| 1, teeth 1-7 | 2.181 | 2.110 | 1.944 | 0.0201* | ** |
| 2, teeth 1-3 | 1.728 | 1.681 | 1.446 | 0.0225* | *** |
| 3, teeth 4-5 | 2.149 | 2.052 | 1.892 | 0.0471* | n.s. |
| 4, teeth 6-7 | 2.887 | 2.808 | 2.738 | 0.1540 n.s. | *** |
| 5, teeth 1-6 | 2.023 | 1.956 | 1.766 | 0.0208* | ** |
| 6, teeth 4-6 | 2.322 | 2.234 | 2.091 | 0.0409* | * |

n.s. not significant, >0.05
*significant, 0.05 > P > 0.01
**significant, 0.01 > P > 0.001
***significant, P < 0.001

TABLE 2

Analysis of variance of the average plaque index per individual, all teeth included

| | Degrees of freedom | Sum of squares | Mean square | Significance P(F) |
|---|---|---|---|---|
| Between brushes | 2 | 0.8031 | 0.4015 | 0.05* |
| Between subjects | 26 | 6.6618 | 0.2562 | 0.01** |
| Remainder, Error | 52 | 4.9505 | 0.0952 | |
| Total | 80 | 12.4154 | | |

TABLE 3

Error Variance (52 Degrees of Freedom, DF) and Sum of squares (SS)
(1) Total between brushes (2 DF)
(2) Between the 2 control brushes A and B (1 DF)
(3) Brush C versus the 2 control brushes A and B (1 DF)

| Line, teeth | Error Variance | Total between brushes SS | Total between brushes P | Between control brushes SS | Between control brushes P | Brush C versus control brushes SS | Brush C versus control brushes P |
|---|---|---|---|---|---|---|---|
| 1, teeth 1-7 | 0.0952 | 0.8031 | * | 0,0698 | 0.2 | 0.7333 | ** |
| 2, teeth 1-3 | 0.1510 | 1.2336 | * | 0.0309 | 0.2 | 1.2027 | ** |
| 3, teeth 4-5 | 0.1402 | 0.9089 | * | 0.1276 | 0.2 | 0.7813 | * |
| 4, teeth 6-7 | 0.0765 | 0.2967 | >0.2 | 0.0836 | 0.2 | 0.2131 | >0.1 |
| 5, teeth 1-6 | 0.1146 | 0.9574 | * | 0.0611 | 0.2 | 0.8963 | ** |
| 6, teeth 4-6 | 0.1080 | 0.7345 | * | 0.1033 | 0.2 | 0.6312 | * |

P are the probabilities of the difference being due to chance (F-Test) not significant, P > 0.05, P > 0.1, or P > 0.2
*significant, 0.05 > P > 0.01
**significant, P < 0.01

TABLE 4

Average Plaque Index on teeth 1-6 buccally and lingually, number of surfaces with grades 2,3 and 4, or grades 3 and 4 and number of buccal and lingual surfaces with grades 3 and 4

| Line, item | Averages A | Averages B | Averages C | Statistical significance: Between control brushes | Statistical significance: Brush C versus control brush |
|---|---|---|---|---|---|
| 1, Index buccally | 1.510 | 1.532 | 1.349 | n.s. | n.s. |
| 2, Index lingually | 2.536 | 2.379 | 2.184 | n.s. | ** |
| 3, Surfaces with 2,3,4 | 34.33 | 34.35 | 30.74 | n.s. | n.s. |
| 4, Surfaces with 3,4 | 13.50 | 11.41 | 9.15 | n.s. | *** |
| Surfaces with 3,4 | | | | | |
| 5, buccally | 1.85 | 2.09 | 1.29 | n.s. | n.s. |

TABLE 4-continued

Average Plaque Index on teeth 1-6 buccally and lingually, number of surfaces with grades 2,3 and 4, or grades 3 and 4 and number of buccal and lingual surfaces with grades 3 and 4

| Line, item | Averages A | Averages B | Averages C | Statistical significance: Between control brushes | Statistical significance: Brush C versus control brush |
|---|---|---|---|---|---|
| 6, lingually | 11.64 | 9.33 | 7.85 | * | ** |

TABLE 5

Average Plaque Index after use of the 4 different degrees of hardness and density (E,K,C,G)

| Line, teeth | E | K | C | G |
|---|---|---|---|---|
| Number of subjects | 6 | 7 | 7 | 7 |
| 1, teeth 1-3 | 1.58 | 1.35 | 1.40 | 1.48 |
| 2, teeth 4-5 | 1.85 | 1.83 | 1.99 | 1.88 |
| 3, teeth 6-7 | 3.01 | 2.55 | 2.88 | 2.55 |
| 4, teeth 1-6 | 1.87 | 1.67 | 1.79 | 1.75 |

There are no statistically significant differences.

What is claimed is:

1. A toothbrush comprising:
a handle having an upper and a lower surface;
a neck connected by one end to said handle;
a straight head piece angled upwardly and ridigly connected to a second end opposite said first end of said neck; and
a bristle array projecting from said head piece having a plurality of bristles of equivalent height so as to form a planar top surface; and
wherein a first angle reference plane coincident with the upper surface of said handle intersects the bristle array in a region of an upper edge of said array adjacent to said neck and wherein an acute angle $\alpha$ formed above and between said angle reference plane and said top surface of said array is from 5° to 20°.

2. A toothbrush according to claim 1, wherein said neck is formed as a straight connecting piece between said head and said handle.

3. A toothbrush according to claim 1, wherein said neck is formed with an angle between said first and said second ends.

4. A toothbrush according to claim 1, wherein said neck is formed as a continuously curved connecting piece.

5. A toothbrush according to claim 1, wherein said head has a surface shape selected from the group consisting of rectangular, rounded and trapezoidal shapes.

6. A toothbrush according to claim 1, further defined by a second angle reference plane coincident with said lower surface of said handle and intersecting at a lower one-half of said bristle array relative to the height of said array.

7. A toothbrush according to claim 1, wherein the first angle reference plane intersects the bristle array in the one-third of the array top surface lying closest to the array edge facing the handle.

8. A toothbrush according to claim 1, wherein the first angle reference plane intersects at an upper one-half of said bristle array relative to the height of said array.

9. A toothbrush according to claim 1, wherein bristle tufts comprising said bristle array in a portion of said array remote from the handle are denser than tufts in a portion of said array nearest the handle.

* * * * *